US005794274A

United States Patent [19]

Kraemer

[11] Patent Number: 5,794,274

[45] Date of Patent: Aug. 18, 1998

[54] CHIN PROTECTOR FOR HELMETS

[75] Inventor: Nelson Kraemer, Mount Prospect, Ill.

[73] Assignee: Riddell, Inc., Chicago, Ill.

[21] Appl. No.: 842,438

[22] Filed: Apr. 24, 1997

[51] Int. Cl.[6] ..... A42B 3/08

[52] U.S. Cl. ..... 2/421; 2/9

[58] Field of Search ..... 2/410, 411, 421, 2/422, 425, 9, 455

[56] References Cited

U.S. PATENT DOCUMENTS

| | | | |
|---|---|---|---|
| 1,262,818 | 4/1918 | McGill . | |
| 2,250,275 | 7/1941 | Riddell | 2/2 |
| 2,867,811 | 1/1959 | Jones | 2/3 |
| 3,187,342 | 6/1965 | Aileo | 2/3 |
| 3,327,313 | 6/1967 | Pukish | 2/3 |
| 3,619,813 | 11/1971 | Marchello | 2/3 |
| 3,787,895 | 1/1974 | Belvedere | 2/9 |
| 3,916,446 | 11/1975 | Gooding | 2/3 |
| 4,044,400 | 8/1977 | Lewicki | 2/421 |
| 4,461,044 | 7/1984 | Reiterman | 2/421 |
| 4,646,368 | 3/1987 | Infussino et al. | 2/421 |
| 4,651,356 | 3/1987 | Zide | 2/421 |
| 4,741,054 | 5/1988 | Mattes | 2/421 |

FOREIGN PATENT DOCUMENTS 1354719 5/1974 United Kingdom .

*Primary Examiner*—Michael A. Neas
*Attorney, Agent, or Firm*—Tobor & Goldstein, L.L.P

[57] ABSTRACT

A chin protector for helmets, such as football helmets, includes an inner member and an outer member, and a suspension arrangement for at least partially suspending, in a spaced relationship, a portion of the outer member from a central portion of the inner member with a gap formed between the inner and outer members, whereby upon an impact force striking the outer surface of the outer member, the force transmitted to a wearer's chin may be attenuated.

15 Claims, 3 Drawing Sheets

CHIN PROTECTOR FOR HELMETS

BACKGROUND OF THE INVENTION

1. Field of the Invention

The invention relates to an improved chin protector for use with helmets, such as football helmets.

2. Description of the Prior Art

Various activities, such as contact sports and hazardous occupations, require the use of helmets to attempt to protect participants from injury to their heads due to impact forces that may be sustained during such activities. A conventional helmet typically includes a chin strap, with a flexible chin cup, or holder, that fits snug about a wearer's chin to secure the helmet to the wearer's head. The chin strap is typically snapped to the lower edges of the helmet. Many conventional chin straps further include a rigid, or semi-rigid, chin guard attached to the outer surface of the flexible chin cup to provide a chin protector to protect the wearer's chin from impact forces.

The conventional chin guard is typically riveted, glued, or otherwise connected directly to the chin cup such that when the helmet is worn, the flexible chin cup and rigid chin guard are layered over the wearer's chin. The rigid chin guard directly abuts the flexible chin cup, and the chin cup directly abuts the wearer's chin across at least a portion of the wearer's chin. Because of potential high forces of impact which may be encountered during athletic and other activities, participants wearing helmets, such as football helmets, may possibly suffer injuries upon receiving an impact force upon the chin. It is against these potentially high forces of impact which conventional chin protectors and the chin protector of the present invention attempt to provide protection.

Conventional chin straps may include perforations in the flexible chin cup and chin guard to allow air circulation around the wearer's chin. Because there are locations along the wearer's chin where there are no perforations in the chin guard, it is believed that conventional chin straps may not allow maximum air circulation for the entire chin. As a result, it is believed that some wearers of conventional chin protectors could suffer skin rashes and other problems associated with insufficient ventilation to their chins.

It should be noted that as to the chin protector of the present invention, as well as prior art chin protectors, due to the nature of the sport of football in particular, no protective equipment can completely prevent injuries to those playing the sport of football. It should be further noted that no protective equipment can completely prevent injuries to a player, if the football player uses his football helmet in an improper manner, such as to butt, ram, or spear an opposing player, which is in violation of the rules of football. Improper use of a helmet to butt, ram, or spear an opposing player can result in severe head and/or neck injuries, paralysis, or death to the football player, as well as possible injury to the football player's opponent. No football helmet or chin protector, such as that of the present invention, can prevent all head, chin, or neck injuries a football player might receive while participating in the sport of football, particularly if the football player improperly uses his helmet.

SUMMARY OF THE INVENTION

In accordance with the invention, the foregoing advantages have been achieved through the present chin protector for use with a helmet. The chin protector of the present invention may include: an inner member including a flexible, substantially cup-shaped central portion having first and second ends, a substantially concave inner surface and a substantially convex outer surface, each surface extending between the first and second ends of the central portion; an outer member including first and second ends, and a cup-shaped shell portion having a substantially concave inner surface and a substantially convex outer surface; and suspension means for at least partially suspending, in a spaced relationship, the shell portion of the outer member from the central portion of the inner member with a gap formed between the inner and outer members, whereby upon an impact force striking the outer surface of the outer member, the force transmitted to a wearer's chin is attenuated. A feature of the invention is that the central portions of the inner member and the shell portion of the outer member are substantially oval-shaped.

Another feature of the present invention is that the central portion of the inner member may be constructed of a material which permits air to flow through the central portion. Another feature of the present invention is that the shell portion of the outer member may include at least one perforation extending from the outer surface of the shell portion to the inner surface of the shell portion to allow air to flow therethrough and into the gap between the inner and outer members. A further feature of the present invention is that the inner and outer members may each have an upper and a lower edge surface, and first and second ends, and the suspension means may be disposed at the first and second ends of the inner and outer members.

An additional feature of the present invention is that the suspension means may be a connector, and the connector may be a rivet. A further feature of the present invention is that a rim cover may be disposed on each of the upper and lower edge surfaces of the outer member. Another feature of the present invention is that the suspension means may be disposed at the upper and lower edge surfaces of the inner and outer members. An additional feature of the present invention is that the upper edge surfaces of the inner and outer members may be connected to each other by a connector disposed along at least a portion of the upper edge surfaces, and the lower edge surfaces of the inner and outer members may be connected to each other by a connector disposed along at least a portion of the lower edge surfaces. A further feature of the present invention is that the connector may be a layer of adhesive.

Another feature of the present invention is that the upper edge surface of the inner member may be connected to the rim cover on the upper edge surface of the outer member by a connector, and the lower edge surface of the inner member may be connected to the rim cover on the lower edge surface of the outer member by a connector. The connectors may each be a layer of adhesive.

The chin protector of the present invention for use with a conventional helmet, when compared with previously proposed prior art chin protectors, has the advantages of being designed to attempt to protect a wearer from the occurrence and severity of injuries upon an impact force striking the chin, and to provide enhanced ventilation to the wearer's entire chin.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figures 1, 2:
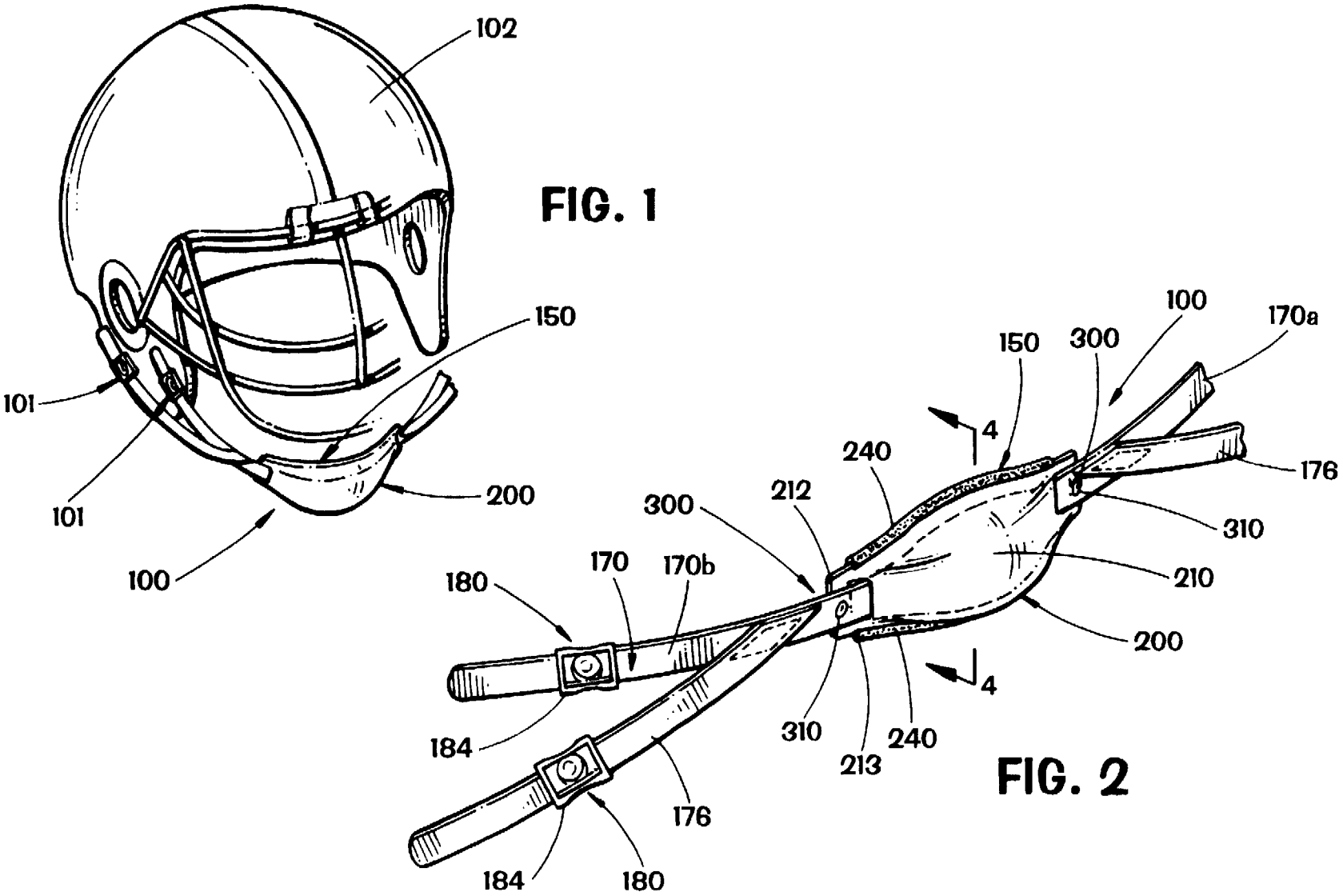
FIG. 1 is a partial perspective view of a helmet having a chin protector in accordance with the present invention.
FIG. 2 is a partial perspective view of a first embodiment of a chin protector in accordance with the present invention.
Figure 3:
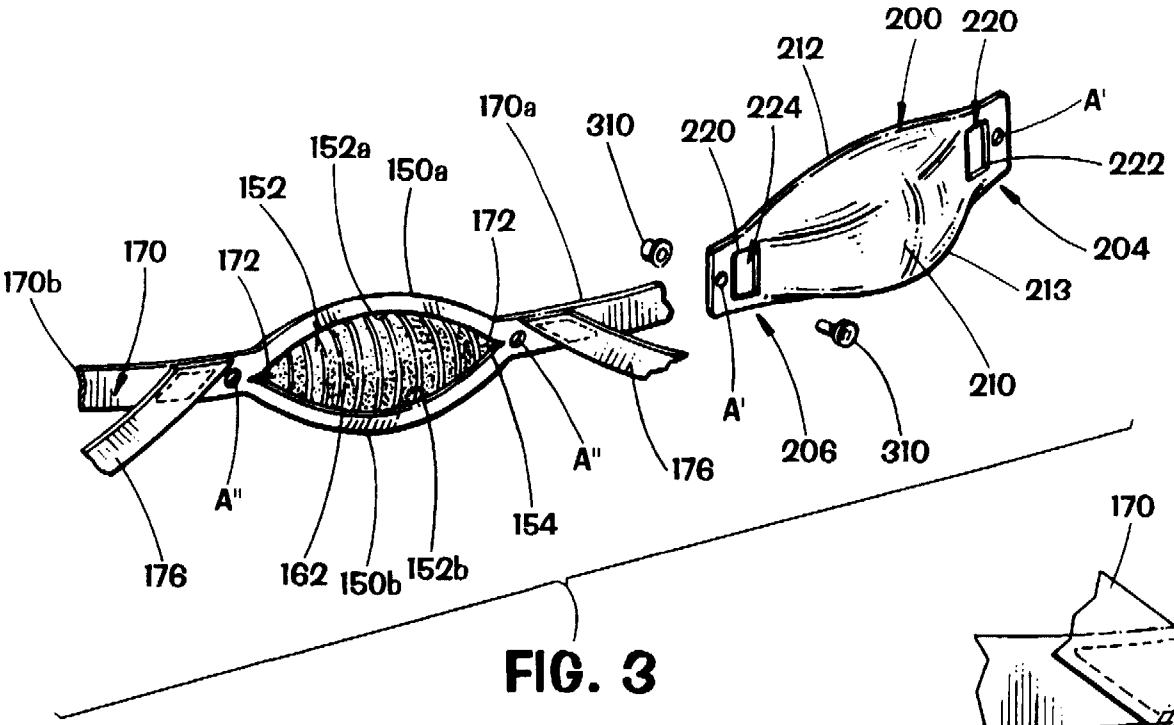
FIG. 3 is a partial exploded perspective view of the chin protector of FIG. 2.

As shown in FIGS. 1–3, a chin protector 100, in accordance with the present invention, generally includes: an inner member, or chin cup assembly, 150 for use with a helmet, such as football helmet 102; an outer member, or protective chin guard, 200; and suspension means 300 for suspending a portion of the outer member 200 in a spaced relationship from a portion of the inner member 150 to attenuate forces transmitted to the helmet wearer's chin (not shown) upon an impact to the outer member 200.

Figure 4:
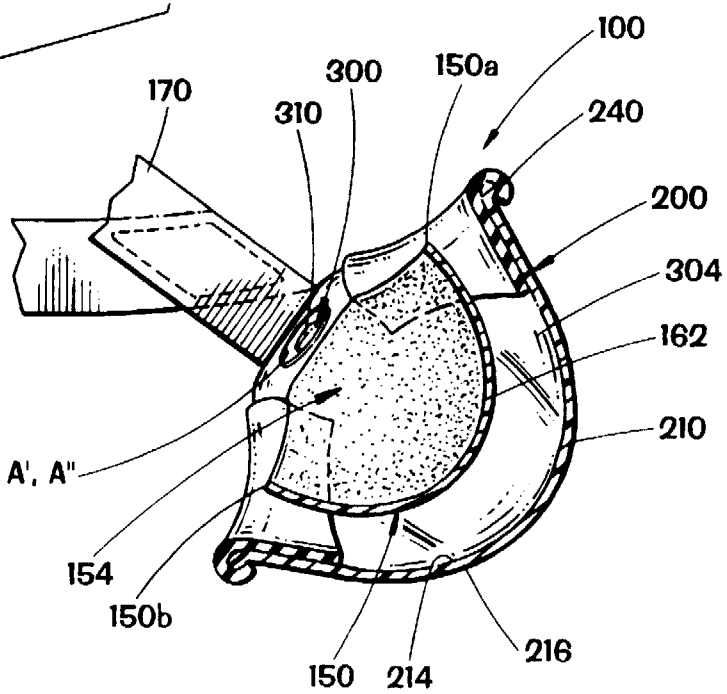
FIG. 4 is a partial cross-sectional view of the chin protector of FIG. 2 taken along line 4—4 of FIG. 2.

With reference to FIGS. 3 and 4, the inner member 150 has upper and lower edges 150*a*, 150*b*, and includes a central portion 152, having upper and lower longitudinal edges 152*a*, 152*b*, and first and second ends 154 and 156, for engaging the helmet wearer's chin. The central portion 152 of inner member 150 may be flexible and is substantially cup, or oval, shaped and has substantially concave inner and convex outer surface 160, 162 (FIGS. 4 and 6) which conform to the helmet wearer's chin (not shown). Each surface 160, 162 extends between the first and second ends 154, 156 of the central portion 152. The central portion 152 may be constructed of a durable, flexible, perforated material, such as woven fabric or nylon. The inner surface 160 of the central portion 152 of inner member 150 may be padded, or lined, with a soft material, such as cotton, for comfort and to help protect the skin of a wearer from abrasion. U.S. Pat. No. 2,867,811 to R. T. Jones illustrates and describes various configurations for, and details of, the construction of a suitable inner member 150.

As shown in FIGS. 1–3 and 5, the inner member 150 of the chin protector 100 further includes a flexible strap 170, having first and second arms 170*a* and 170*b* which extend substantially laterally from the first and second ends 154, 156 of the central portion 152, respectively, for connecting the chin protector 100 to helmet 102. The strap 170 can be constructed of any flexible, durable, high tensile strength material, such as plastic impregnated nylon. The strap 170 may be connected to the inner member 150 in any conventional manner, such as by heat sealing, sewing, or other suitable means. Preferably, as shown in FIG. 3, the strap 170 is longitudinally split at the center thereof, as indicated at 172, to run along the upper and lower longitudinal edges 152*a*, 152*b* of the central portion 152 of the inner member 150. The central portion 152 of inner member 150 is then connected to strap 170 along edges 152*a*, 152*b*, as by heat sealing, or sewing, central portion to strap 170.

Figure 5:
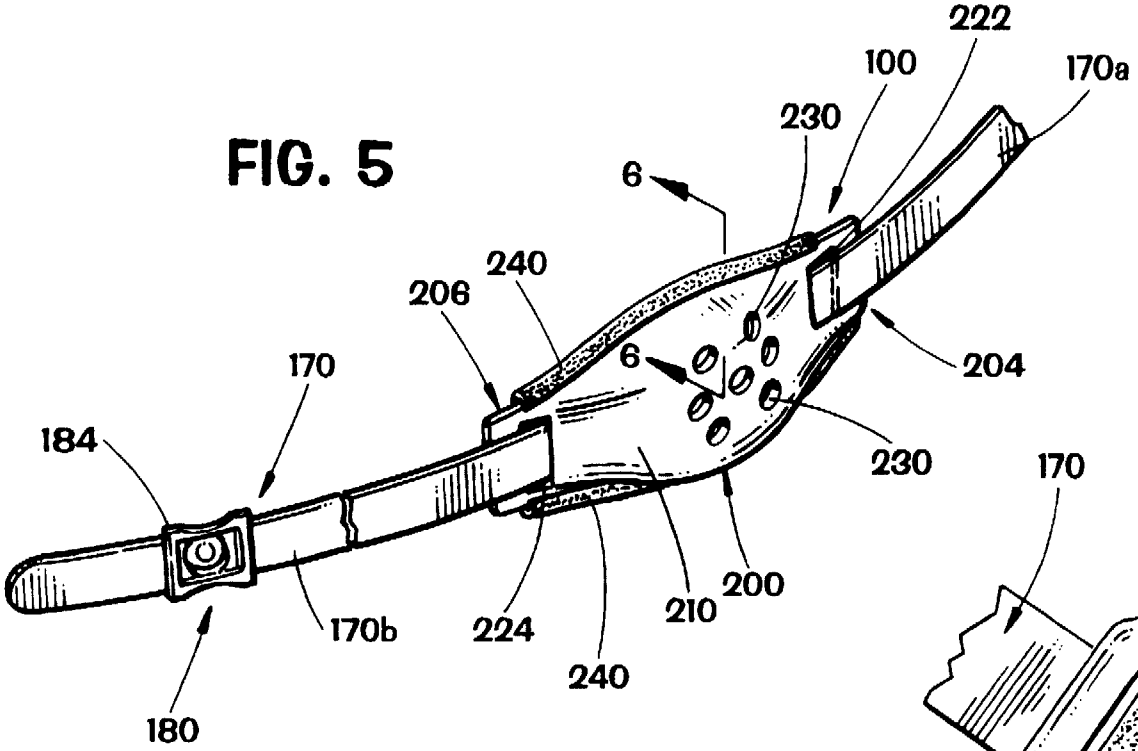
FIG. 5 is a partial perspective view of a second embodiment of a chin protector in accordance with the present invention.

Each arm 170*a*, 170*b* of the strap 170 includes attachment means 180 for attaching the inner member 150 to helmet 102. The attachment means 180 can be laterally adjustable snap connectors 184, as shown in FIGS. 2 and 5, or any other suitable connectors. The snap connectors 184 are releasably matable with corresponding snap connectors disposed on the helmet 102 as indicated at 101 (FIG. 1). As shown in FIGS. 2 and 3, strap 170 may also include attachment legs, or straps, 176 extending angularly from arms 170*a*, 170*b* of strap 170 to provide increased stability upon attachment to helmet 102. Each leg 176 may also include attachment means 180 which are similar, or identical, to the attachment means 189 of the strap 170, for further attachment to helmet 102. The strap 170 shown in FIG. 5 does not include the additional attachment legs, or straps, 176.

As illustrated in FIG. 3, the outer member 200 of the chin protector 100 has first and second ends 204, 206, upper and lower edge surfaces 212, 213, shell portion 210, and securing means 220 for securing the outer member 200 to the inner member 150 of the chin protector 100. The outer member 200 may be constructed of a rigid, or semi-rigid, material having the requisite strength characteristics to withstand the forces of impact that may occur during contact sports such as football, or other activities. Preferably, outer member 200 is formed of a suitable plastic material such as polycarbonate or ABS plastic, or any other plastic material known to those of ordinary skill in this art. As shown in FIGS. 2, 4, and 5, the shell portion 210 of the outer member 200 is cup, or oval, shaped to fit over the central portion 152 of the inner member 150, and has substantially concave inner and substantially convex outer surfaces 214, 216 to likewise fit over the wearer's chin. As shown in FIG. 5, the outer member 200 may include perforations 230 to allow for air flow through outer member 200 for enhanced ventilation to the entire chin of the wearer, as will be hereinafter described in greater detail. Additionally, the shell portion 210 may include a "crumple zone", whereby upon a predetermined amount of force being absorbed by the shell portion, it will crumple, or deform, to attempt to absorb additional impact forces.

The securing means 220 allows the outer member 200 to cover the inner member 150 and maintains the position of the central portion 152 of the inner member 150 within the shell portion 210 of the outer member 200. The securing means 220 of the outer member 200, as shown in FIG. 3, includes first and second slots 222, 224 disposed at the first and second ends 204, 206 of the outer member 200. The outer member 200 may thus be secured to the inner member 150 with the slots 222, 224 by positioning the central portion 152 of the inner member 150 within the shell portion 210 of the outer member 200 and inserting the first strap leg 170*a* through the slot 222 and the second strap leg 170*b* through the slot 224.

An outer member rim cover 240, as shown in FIGS. 2 and 5, may be disposed over the upper and/or lower edges 212, 213 of the outer member 200 to protect a wearer's chin from abrasion due to direct contact with the upper or lower edges 212, 213 of the outer member 200. The rim cover 240 may be constructed of a synthetic rubber, or plastic, material, or any other suitable material, having the requisite strength and cushioning characteristics to cushion the upper and lower edges 212, 213 of the outer member 220. Cover 240 may be removable, or permanently affixed to the outer member 200 with glue, or other suitable means. The rim cover 240 for the chin protector 100 of FIGS. 2 and 4 may be glued to the inner surface 214 of the shell portion 210 of the outer member 200. As will be hereinafter described in greater detail, the rim cover 240 for the chin protector 100 of FIGS. 5 and 6 may be secured, as by glue or a heat seal, to the outer surface of inner member 150.

With reference to FIGS. 2–6, chin protector 100 is provided with a suspension means 300 to connect the inner and outer members 150, 200 in a spaced relationship with respect to each other, so as to suspend the shell portion 210 of the outer member 200 over the central portion 152 of the inner member 150 to absorb shock forces to the wearer's chin. The suspension means 300 may be disposed at any location along the peripheries of the inner and outer members 150, 200 to suspend the shell portion 210 of the outer member 200 at least partially over the central portion 152 of the inner member 150. As shown in FIGS. 2–4, the suspension means 300 may be located at a set of two points indicated at A' and A" (FIG. 3) on the inner and outer members 150, 200, respectively, disposed at the ends 204, 206 of the outer member 200 and upon the legs 170*a*, 170*b* of the strap 170 proximate the ends 154, 156 of the central portion 152 of the inner member 150. A conventional rivet 310, or any other suitable connector, such as a snap, coupler, stitching, or Velcro, may be used as suspension means 300 to connect the inner and outer members 150, 200, at points A' and A", in a spaced relationship with respect to each other, provided the connector has the requisite strength to keep the inner and outer members 150, 200 secured to each other.

As shown in FIG. 4, a gap 304 is formed between the central portion 152 of the inner member 150 and the shell portion 210 of the outer member 200. By removing substantially all, or some, of the slack in the central portion 152 of the flexible inner member 150 when the inner and outer members 150, 200 are connected with suspension means 300, the inner member 150 thereafter flexes, or gives, upon impact to the outer member 200. As a result, the forces transmitted to a wearer's chin upon impact to the outer surface 216 of the shell portion 210 are reduced, or attenuated. Further, since there is no point on the wearer's chin where the shell portion 210 of the outer member 200 is layered thereupon, any forces not absorbed by the shell portion 210 of the outer member 200 are not directly transmitted to the wearer's chin, but dissipate at the ends 204, 206 of the outer member 200. The gap 304 between the flexible, perforated central portion 152 of the inner member 150 and the shell portion 210 of the outer member 200 allows air circulation, or ventilation, between the inner and outer members 150, 200 and about the entire surface area of the chin of a wearer.

Figure 6:
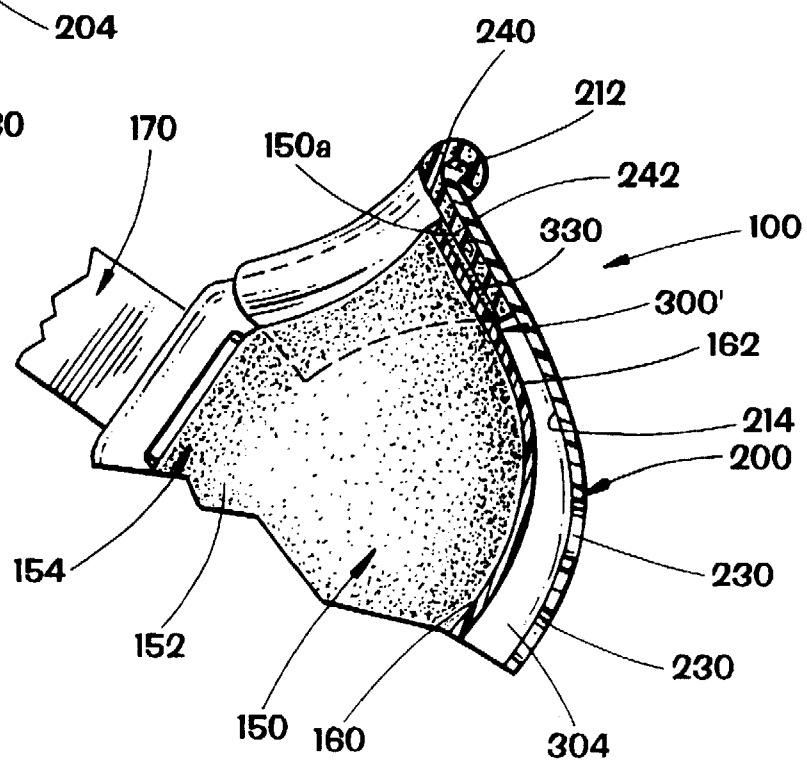
FIG. 6 is a partial cross-sectional view of the chin protector of FIG. 5 taken along lines 6—6 of FIG. 5.

The suspension means 300' of the chin protector 100 of FIGS. 5 and 6 may be disposed on the inner and outer members 150, 200 at a point on, or along, at least a portion of their respective upper and lower edges 150*a*, 212; 150*b*, 213. As shown in FIG. 6, the upper edge 150*a* of the inner member 150 is connected to the upper edge 212 of the outer member 200 by the upper rim cover 240 which is secured to the outer surface 162 of inner member 150, in any conventional manner as by gluing or heat sealing upper rim cover 240 to inner member 150, a layer of glue 330 being illustrated in FIG. 6. Lower rim cover 240 may similarly be connected, or secured, to the lower edge 150*b* of the inner member 150 by securing lower rim cover 240 to the outer surface 162 of inner member 150 in the same manner as previously described. The suspension means 300' may use any among a variety of connectors, such as a heat-seal, epoxy, Velcro, stitching, or matable means which are suitable for maintaining a connection between the inner member 150 and the rim cover 240. If a rim cover 240 is not used, a clip or any previously described connector may be used as securing means 300' to extend between, and connect, at least a portion of the upper and lower edges of the inner and outer members 150, 200. A gap 304 is similarly formed between the inner and outer members 150, 200 for force attenuation and ventilation, as described above with reference to FIG. 4.

It is to be understood that the invention is not limited to the exact details of construction, operation, exact materials or embodiments shown and described, as obvious modifications and equivalents will be apparent to one skilled in the art; for example, a combination of suspension means at different locations on the peripheries of the inner and outer members may be used to suspend the inner and outer members in a spaced relationship from each other. Accordingly, the invention is therefore to be limited only by the scope of the appended claims.

I claim:

1. A chin protector for use with a helmet, comprising:

an inner member including a flexible, substantially cup-shaped central portion having first and second ends and shaped to receive a wearer's chin, a substantially concave inner surface and a substantially convex outer surface, each surface extending between the first and second ends of the central portion;

an outer member including first and second ends, and a cup-shaped shell portion having a substantially concave inner surface and a substantially convex outer surface; and suspension means for at least partially suspending, in a spaced relationship, the shell portion of the outer member from the central portion of the inner member with a gap formed between the inner and outer members, whereby upon an impact force striking the outer surface of the outer member, the force transmitted to a wearer's chin is attenuated.

2. The chin protector of claim 1, wherein the central portions of the inner member and the shell portion of the outer member are substantially oval shaped.

3. The chin protector of claim 1, wherein the central portion of the inner member is constructed of a material which permits air to flow through the central portion.

4. The chin protector of claim 1, wherein the shell portion of the outer member includes at least one perforation extending from the outer surface of the shell portion to the inner surface of the shell portion to allow air to flow therethrough and into the gap between the inner and outer members.

5. The chin protector of claim 1, wherein the inner and outer members each have an upper and a lower edge surface, and first and second ends.

6. The chin protector of claim 5, wherein the suspension means is disposed at the first and second ends of the inner and outer members.

7. The chin protector of claim 6, wherein the suspension means is a connector.

8. The chin protector of claim 7, wherein the connector is a rivet.

9. The chin protector of claim 5, wherein a rim cover is disposed on each of the upper and lower edge surfaces of the outer member.

10. The chin protector of claim 5, wherein the suspension means is disposed at the upper and lower edge surfaces of the inner and outer members.

11. The chin protector of claim 10, wherein the upper edge surfaces of the inner and outer members are connected to each other by a connector disposed along at least a portion of the upper edge surfaces, and the lower edge surfaces of the inner and outer members are connected to each other by a connector disposed along at least a portion of the lower edge surfaces.

12. The chin protector of claim 11, wherein the connector is a layer of adhesive.

13. The chin protector of claim 10, wherein a rim cover is disposed on each of the upper and lower edge surfaces of the outer member.

14. The chin protector of claim 13, wherein the upper edge surface of the inner member is connected to the rim cover on the upper edge surface of the outer member by a connector, and the lower edge surface of the inner member is connected to the rim cover on the lower edge surface of the outer member by a connector.

15. The chin protector of claim 14, wherein the connectors are each a layer of adhesive.

* * * * *